US007963627B2

(12) United States Patent
Ito

(10) Patent No.: US 7,963,627 B2
(45) Date of Patent: Jun. 21, 2011

(54) LIQUID DROPLET JETTING-INSPECTION APPARATUS AND LIQUID DROPLET JETTING-INSPECTION METHOD

(75) Inventor: Masaharu Ito, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 531 days.

(21) Appl. No.: 12/151,834

(22) Filed: May 9, 2008

(65) Prior Publication Data

US 2008/0309705 A1 Dec. 18, 2008

(30) Foreign Application Priority Data

May 11, 2007 (JP) ..... 2007-126835

(51) Int. Cl.
*B41J 29/393* (2006.01)

(52) U.S. Cl. ..... 347/19

(58) Field of Classification Search ..... 347/9–11, 347/19, 76–78, 81
See application file for complete search history.

(56) References Cited

U.S. PATENT DOCUMENTS 5,621,524 A * 4/1997 Mitani ..... 356/338
6,076,914 A 6/2000 Imai
2002/0171717 A1* 11/2002 Satou et al. ..... 347/77
2004/0207676 A1* 10/2004 Yamada et al. ..... 347/19

FOREIGN PATENT DOCUMENTS

JP 3531380 3/2004

* cited by examiner

*Primary Examiner* — Lamson D Nguyen
(74) *Attorney, Agent, or Firm* — Frommer Lawrence & Haug LLP

(57) ABSTRACT

A pressurized liquid is supplied to an ink-jet head, and is discharged continuously from nozzles. In this state, a driving signal is applied to the ink-jet head at a predetermined time interval, and a light source is made to emit light in multiples of the predetermined time interval. Liquid droplets which are jetted continuously in the form of beads from the nozzles by the driving signal are picked up, and bending in a direction of jetting and state of liquid droplets are observed. Accordingly, a liquid droplet jetting-inspection apparatus and a liquid droplet jetting-inspection method which are capable of detecting easily a defect which is caused due to a channel and a nozzle as well as an electrical structure and a drive element of a liquid droplet-jetting apparatus are provided.

8 Claims, 10 Drawing Sheets

LIQUID DROPLET JETTING-INSPECTION APPARATUS AND LIQUID DROPLET JETTING-INSPECTION METHOD

CROSS REFERENCE TO RELATED APPLICATION

The present application claims priority from Japanese Patent Application No. 2007-126835, filed on May 11, 2007, the disclosure of which is incorporated herein by reference in its entirety.

BACKGROUND OF THE INVENTION

1. Field of the Invention

The present invention relates to a liquid droplet jetting-inspection apparatus which inspects or tests a liquid droplet-jetting apparatus that jets a liquid droplet from a nozzle, such as an ink-jet head, and a liquid droplet jetting-inspection method.

2. Description of the Related Art

In recent years, an ink-jet head has put in practical use, and an inspection apparatus for the ink-jet head which detects a jetting quality of the ink-jet head has already been known. This ink-jet head cause, based on a drive signal applied from a driving circuit, a pressure fluctuation or change in a pressure chamber in which an ink is stored. Due to the pressure change, an ink droplet of the ink is jetted from a nozzle communicating with the pressure chamber. Further, the driving circuit and a drive element are grounded via a ground line. In an inspection apparatus disclosed in Japanese Patent No. 3531380, a waveform of an electric current flowing through the ground line is detected; and based on the current waveform, a current waveform or a drive voltage of the drive signal outputted to the ink-jet head from the driving circuit is presumed, thereby making it possible to judge the quality of the ink-jet head (to judge the presence or absence of any jetting defect).

In this manner, in the conventional inspection apparatus, the quality of the ink-jet head is judged by detecting the waveform of the electric current flowing through the ground line. Therefore, although it is possible to judge the quality for the driving circuit, the drive element of the ink-jet head, and a signal line connecting the driving circuit and the drive element, no consideration is made for any mis-jetting (jetting failure) of the ink droplet and any bending or deviation of the ink droplet from an intended jetting direction (bending in the jetting direction) due to any clogging in the ink channel and/or the nozzle or due to any damage of the ink channel and/or the nozzle. The bending of the ink droplets is one of the factors causing the deterioration of image quality. So far, as an inspection method of the bending of ink droplet, there are proposed inspection methods such as observing the jetting condition for each nozzle with an image pickup device apparatus having an extremely short image pickup (taking or photographing) time, detecting the bending of ink droplets by actually performing the printing, etc. However, much time and effort are required for these methods.

SUMMARY OF THE INVENTION

In view of such situations, an object of the present invention is to provide a liquid droplet jetting-inspection apparatus and a method of inspection liquid droplet-jetting (liquid droplet jetting-inspection method) which are capable of easily detecting any defect (jetting defect or jetting failure) caused due to clogging, damage, etc. of a channel and/or a nozzle of a liquid droplet-jetting apparatus, in addition to any defect caused due to the electrical structure, the drive element, etc. of the liquid droplet-jetting apparatus.

According to a first aspect of the present invention, there is provided a liquid droplet jetting-inspection apparatus which inspects jetting of a liquid droplet-jetting apparatus having a nozzle through which liquid droplets of a liquid are jetted and causing change in pressure of the liquid based on a predetermined driving signal to jet the liquid droplets from the nozzles, the liquid droplet jetting-inspection apparatus including:

a pressurized liquid supply mechanism which pressurizes the liquid, and supplies the pressurized liquid to the liquid droplet-jetting apparatus to make the liquid be discharged continuously from the nozzle; and a liquid droplet-jetting control mechanism which applies the driving signal at a predetermined time interval to the liquid droplet-jetting apparatus during the liquid is continuously discharged from the nozzle; and a light emitting mechanism which includes a light source, and which makes the light source emit light at a time interval that is an integer multiply of the predetermined time interval.

According to the first aspect of the present invention, when the pressurized liquid is supplied by the pressurized liquid supply mechanism to the liquid droplet-jetting apparatus, the liquid is continuously discharged or flowed out from the nozzle of the liquid droplet-jetting apparatus. In addition, when the driving signal is applied or imparted at the predetermined time interval to the liquid droplet-jetting apparatus in this state, the liquid droplets generated due to driving the liquid droplet jetting apparatus are added, at the predetermined time interval, to the continuously discharging liquid. By making the light source emit the light and by irradiating the liquid droplets with the light at a time interval which is an N-fold number (N-times; wherein N is a positive integer) of the predetermined time interval, it is possible to observe during which a plurality of liquid droplets are lining in beads-like manner. When the emission interval is N times, the liquid droplets are observed in a pseudo stationary state, and when the emission interval is slightly different from the N times, the liquid droplets are observed in a slow-motion state. In the present patent application, the term "N times (integer multiply of N)" is a concept encompassing also the case in which the emission interval is slightly different (deviated) from the N time as described above.

Regarding the bending of jetting direction and the mis-jetting (jetting failure) due to the clogging of the channel and/or the nozzle, or due to any damage of the channel and/or the nozzle, it is possible to judge that there is bending and jetting failure when a continuous line of the liquid discharged or flowed out from the nozzle by the pressurized liquid supply mechanism is inclined with respect to a normal line of the liquid, or when the continuous line of the liquid is not observed as a line. Further, with respect to the driving state of the liquid droplet-jetting apparatus also, a similar judgment can be made by confirming (observing) whether or not a line formed by the plurality of continuous liquid droplets is inclined with respect to the line of the liquid droplets jetted normally, or whether or not the liquid droplets are not jetted. Furthermore, in the latter case, it is possible to judge, whether or not there is any defect due to the electrical structure and/or the drive element, by observing whether the liquid droplets are formed normally or not formed. Consequently, even without using any expensive image pickup mechanism having an extremely short image pickup time, it is possible to easily inspect both of the defect caused by the channel and/or the nozzle and the defect caused by the electrical structure and/or the drive element of the liquid droplet-jetting apparatus.

In the liquid droplet jetting-inspection apparatus of the present invention, the light emitting mechanism may have a synchronized drive circuit which makes the lights source emit the light in synchronization with the driving signal. In this case, since the light emitting mechanism makes the light source emit the light in synchronization with the driving signal, it is possible to use the driving signal as a timing for making the light source emit the light, thus eliminating the need for generating any new signal for measuring the timing. Therefore, it is possible to simplify the structure of the liquid droplet jetting-inspection apparatus.

The liquid droplet jetting-inspection apparatus of the present invention may further include an image pickup mechanism which takes (picks up or photographs) an image of the liquid jetted from the nozzles, during which the pressurized liquid supply mechanism and the light emitting mechanism are operating.

In this case, it is possible to take a stationary image or a moving image of the liquid droplets while the liquid droplets are lining in beads-like manner as described above, only by taking an image of the liquid by the image pickup mechanism during the pressurized liquid supply mechanism and the light emitting mechanism are operating or activated. Accordingly, it is possible to easily inspect a defect of the liquid droplet-jetting apparatus, from the image even without using any expensive image pickup mechanism having an extremely short image pickup time.

The liquid droplet jetting-inspection apparatus of the present invention may further include a defect detecting mechanism which detects a defect, of the liquid droplet-jetting apparatus, based on the image taken by the image pickup mechanism.

In this case, it is possible to detect a defect of the liquid droplet-jetting apparatus based on the image taken by the image pickup mechanism, and to detect the defect (such as the liquid droplet-jetting failure) assuredly and easily.

In the liquid droplet jetting-inspection apparatus of the present invention, the pressurized liquid supply mechanism may include: a tank which stores the liquid; a pump which pressurizes the liquid; and a piping which connects the tank and the pump to the liquid droplet-jetting apparatus. Moreover, the pressurized liquid supply mechanism may further include a frame which fixes the liquid droplet-jetting apparatus, and a jig including a joint which is fixed to the frame and which connects the piping to the liquid droplet-jetting apparatus so that the liquid is communicable between the piping and the liquid droplet-jetting apparatus. In these cases, even when the liquid droplet-jetting apparatus does not have a tank which stores the liquid, etc., it is possible to inspect the jetting condition of the liquid by the liquid droplet jetting-inspection apparatus. For example, even when the liquid droplet-jetting apparatus is in an unfinished state, and thus has only the actuator and the channel unit, it is possible to perform the inspection for such unfinished liquid jetting apparatus.

In the liquid droplet jetting-inspection apparatus of the present invention, the pressurized liquid supply mechanism may further include a pressure control valve which adjusts the pressure of the liquid. In this case, it is possible to adjust the pressure of the liquid to be constant.

In the liquid droplet jetting-inspection apparatus of the present invention, the liquid may be a colored liquid. In this case, since an image with a high contrast can be obtained, it is possible to distinguish a locus (track) of the liquid in a detailed manner, thereby improving the reliability of inspection.

According to a second aspect of the present invention, there is provided a liquid droplet jetting-inspection method of inspecting jetting of a liquid droplet-jetting apparatus having a nozzle through which liquid droplets of a liquid are jetted and causing change in a pressure of the liquid based on a predetermined driving signal to jet the liquid droplets from the nozzle, the liquid droplet jetting-inspection method including:

pressurizing a liquid, and supplying the pressurized liquid to the liquid droplet-jetting apparatus to discharge the liquid continuously from the nozzle;

applying the driving signal at a predetermined time interval to the liquid droplet-jetting apparatus, during which the liquid is discharged continuously from the nozzle;

making a light source emit a light in synchronization with the driving signal;

taking an image of the liquid jetted from the nozzle, during which the driving signal is applied at the predetermined time interval to the liquid droplet-jetting apparatus and that the light source is made to emit the light; and inspecting the jetting of the liquid from the liquid droplet-jetting apparatus, based on the taken image.

According to the second aspect of the present invention, when the pressurized liquid is supplied to the liquid droplet-jetting apparatus, the liquid is discharged continuously from the nozzle of the liquid droplet-jetting apparatus, and further when the driving signal is applied, at the predetermined time interval, to the liquid droplet-jetting apparatus in this state, then the liquid droplets generated due to driving the liquid droplet-jetting apparatus are added to the continuously outflowing liquid at the predetermined time interval. By irradiating the liquid and the liquid droplets with the light emitted by the light source substantially in synchronization with the driving signal, it is possible to take (photograph), by the image pickup mechanism, an image of the liquid droplets in a state that the liquid droplets are lining in beads-like manner. Regarding the jetting defect caused due to the clogging or the damage of the channel and/or the nozzle, it is possible to judge that there is a defect when a continuous line of the liquid discharged from the nozzle by the pressurized liquid supply mechanism is inclined with respect to the normal line of the liquid, or when the continuous line is not observed as a line. Furthermore, with respect to the driving state of the liquid droplet jetting apparatus also, a similar judgment can be made by confirming (observing) that a line formed by the plurality of continuous liquid droplets is inclined with respect to the line of the normally jetted liquid droplets, or when the liquid droplets are not jetted. Further, in the latter case, it is possible to judge whether or not there is any defect due to the electrical structure and/or the drive element by observing whether the liquid droplets are formed normally or the liquid droplets are not formed. Accordingly, it is possible to easily perform the inspection for both the defect due to the channel and/or the nozzle of the liquid droplet-jetting apparatus and the defect due to the electrical structure and the drive element of the liquid droplet-jetting apparatus, even without using any expensive image pickup mechanism having an extremely short image pickup time.

In the liquid droplet jetting-inspection method of the present invention, the application of the driving signal may be started after making the liquid be discharged continuously from the nozzle. Accordingly, as described above, firstly the inspection can be made for any jetting defect and the bending of the jetting direction due to the channel and/or the nozzle, only with the pressurized liquid supplying step; and then the inspection can be performed for any defect due to the electrical structure and/or the drive element.

As clarified by the above explanation, according to the present invention, it is possible to easily detect a defect due to the channel, the nozzle, the electrical structure, the drive element, etc. of the liquid droplet-jetting apparatus.

DETAILED DESCRIPTION OF THE PREFERRED EMBODIMENTS

An embodiment according to the present invention will be described below with reference to the accompanying diagrams.

Figure 1:
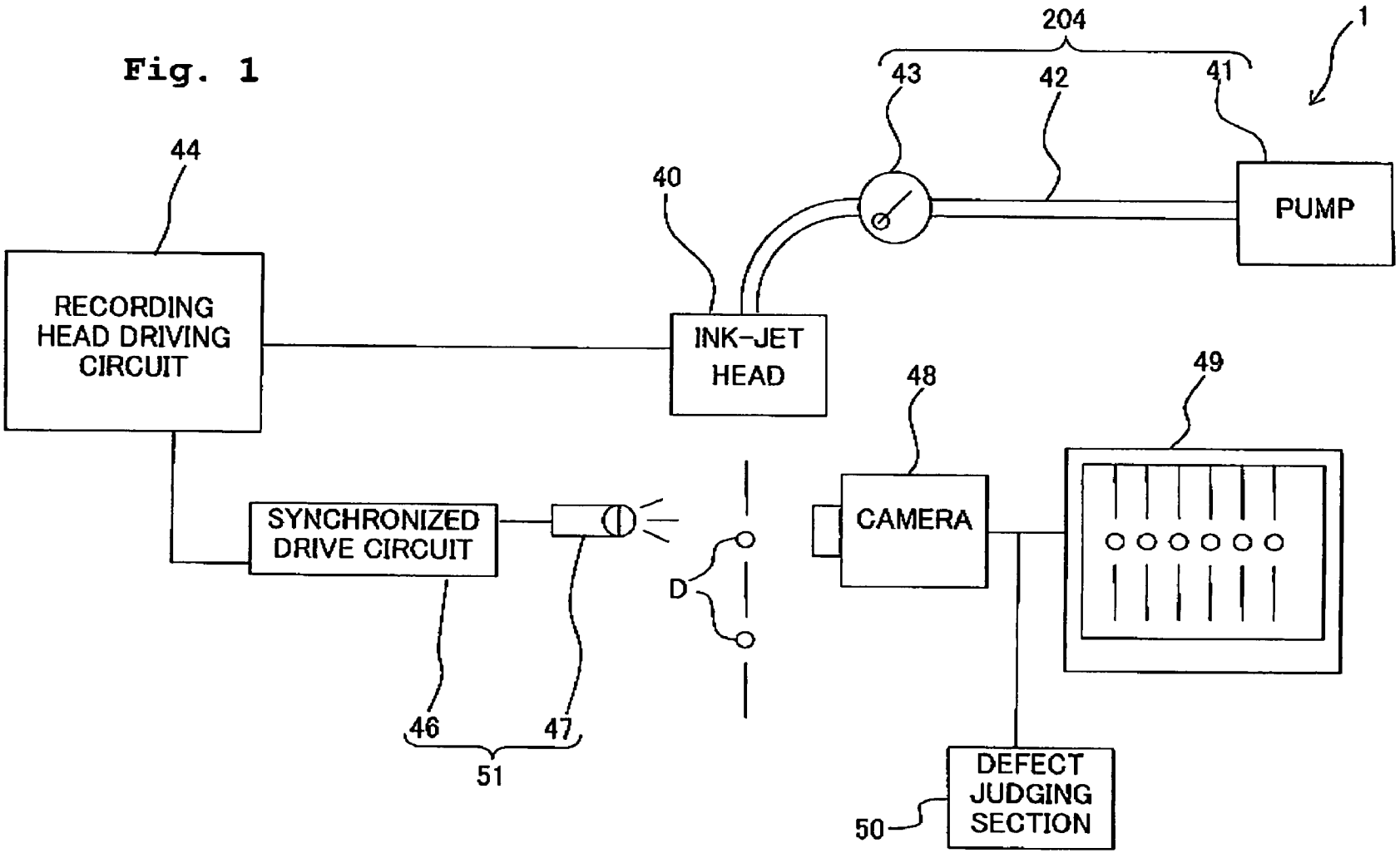
FIG. 1 is a block diagram showing a structure of a liquid droplet jetting-inspection apparatus according to the present invention.

FIG. 1 is a block diagram showing a structure of a liquid droplet jetting-inspection apparatus 1 according to the present invention. The liquid droplet jetting-inspection apparatus 1 is an apparatus which inspects a defect in an ink-jet head (liquid droplet-jetting apparatus) 40 which is capable of jetting ink droplets based on a driving signal from an outside. In the following description, firstly, the structure of the ink-jet head which is an object to the inspection will be described below. Then, the structure of the liquid droplet jetting-inspection apparatus 1 will be described.

Figure 2:
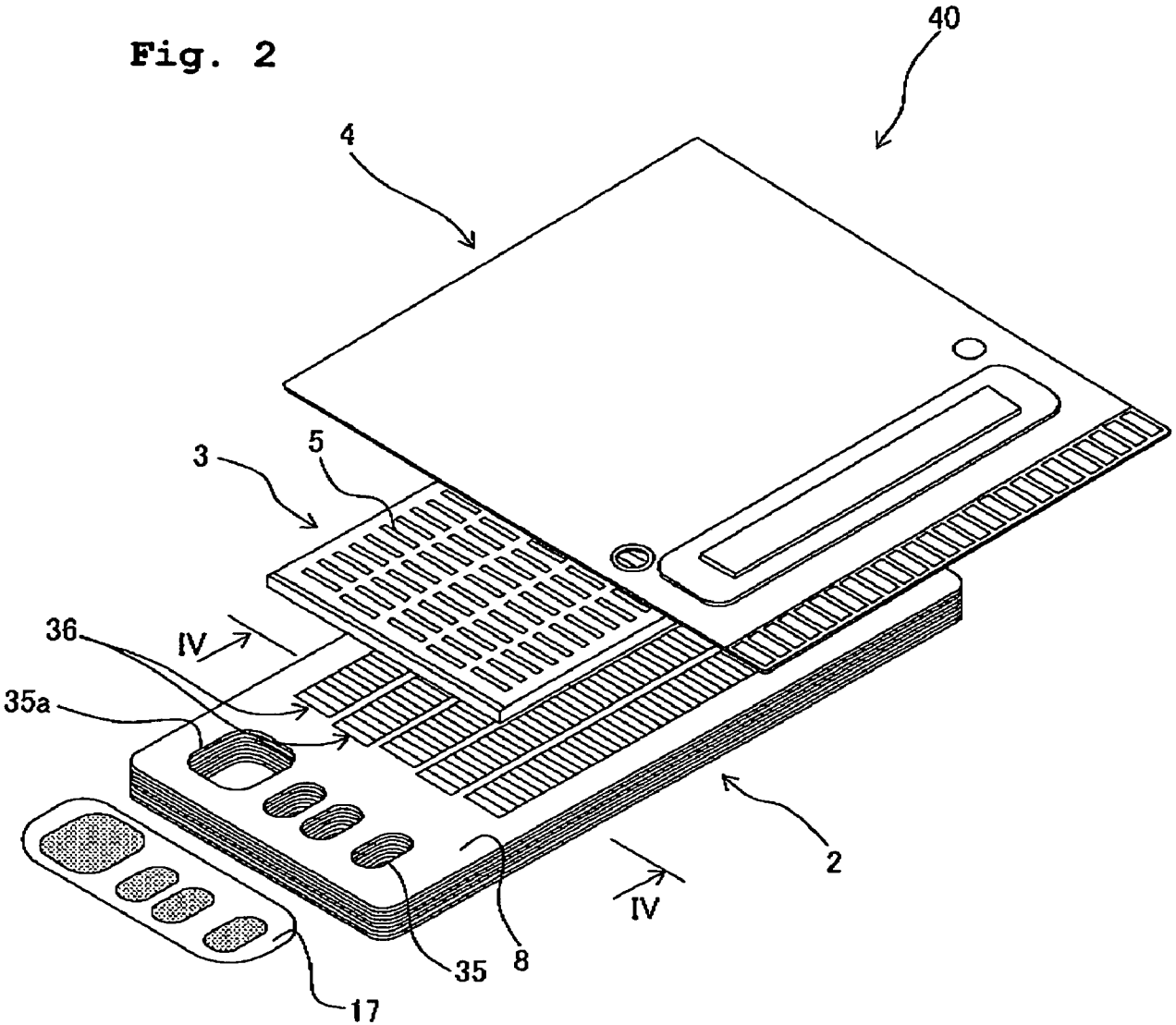
FIG. 2 is an exploded perspective view of an ink-jet head.

FIG. 2 is an exploded perspective view showing the ink-jet head 40. As shown in FIG. 2, the ink-jet head 40 includes a channel unit 2 in which a plurality of plates are stacked, and a piezoelectric actuator 3 which is overlaid on and adhered to the channel unit 2. A flexible flat cable 4 electrically connected to an external equipment is overlaid and adhered onto the upper surface of the actuator 3. A plurality of surface electrodes 5 is formed on the upper surface of the actuator 3. Further, a plurality of terminals (not shown in the diagram) is exposed on the lower surface of the flexible flat cable 4. The surface electrodes 5 and the terminals are brought into electrical conduction by corresponding and connecting the surface electrodes 5 with the respective terminals. Furthermore, the flexible flat cable 4 has a plurality of signal wires (not shown in the diagram). The signal wires are in electrical conduction with the terminals respectively, and are electrically connected to the external equipment. Therefore, a driving signal imparted (applied) from the external equipment is transmitted individually to the surface electrodes 5 through the signal wires of the flexible flat cable 4. The driving signal will be described later on. Regarding a concept of "directions" used in the following description, a side on which the actuator 3 is provided to the channel unit 2 is an upper side (upward direction), and a side opposite to the upper side is a lower side (downward direction). Direction other than the upward and downward directions will be described as appropriate.

Figure 3:
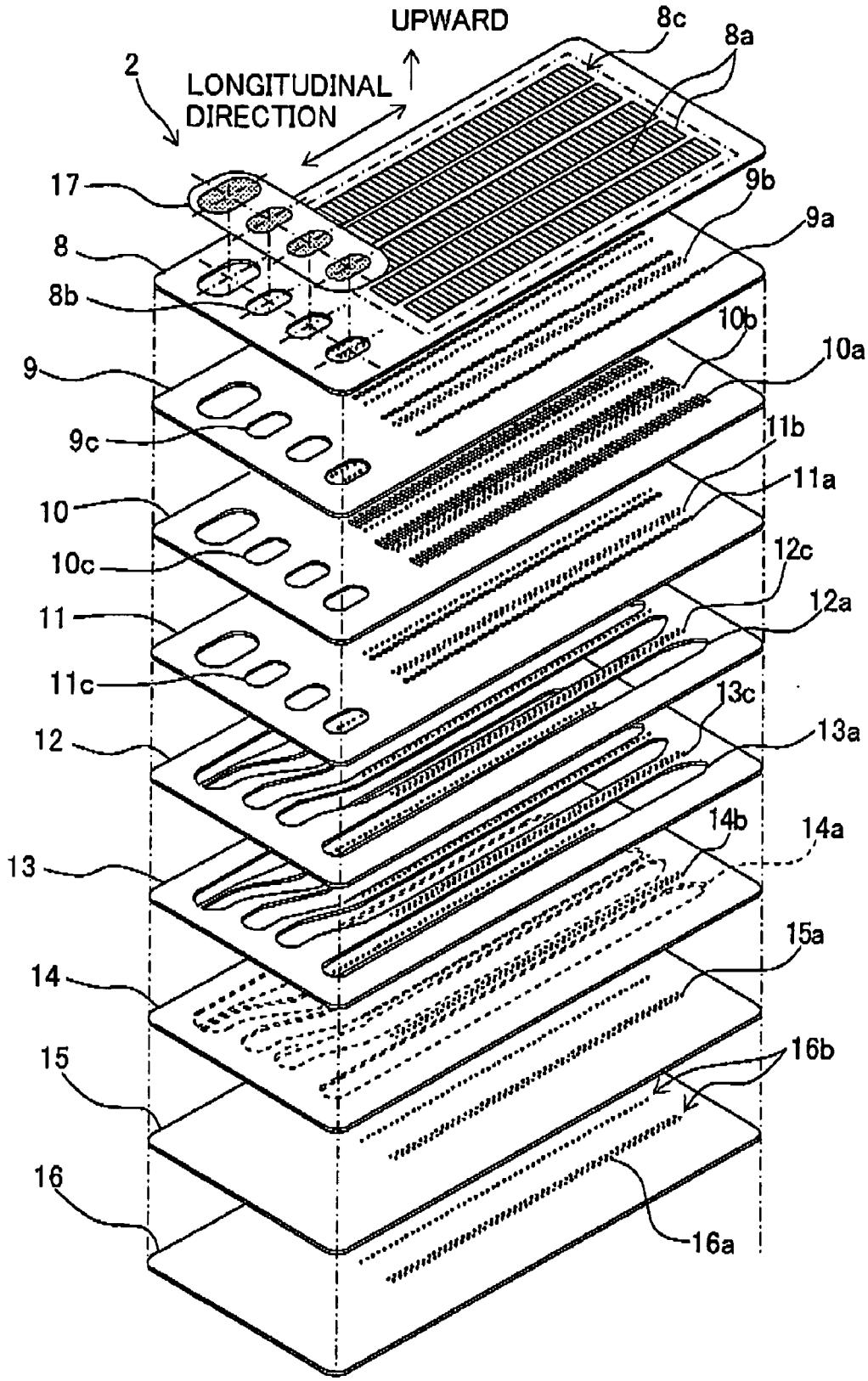
FIG. 3 is an exploded perspective view showing the structure of a channel unit shown in FIG. 2.
Figure 4:
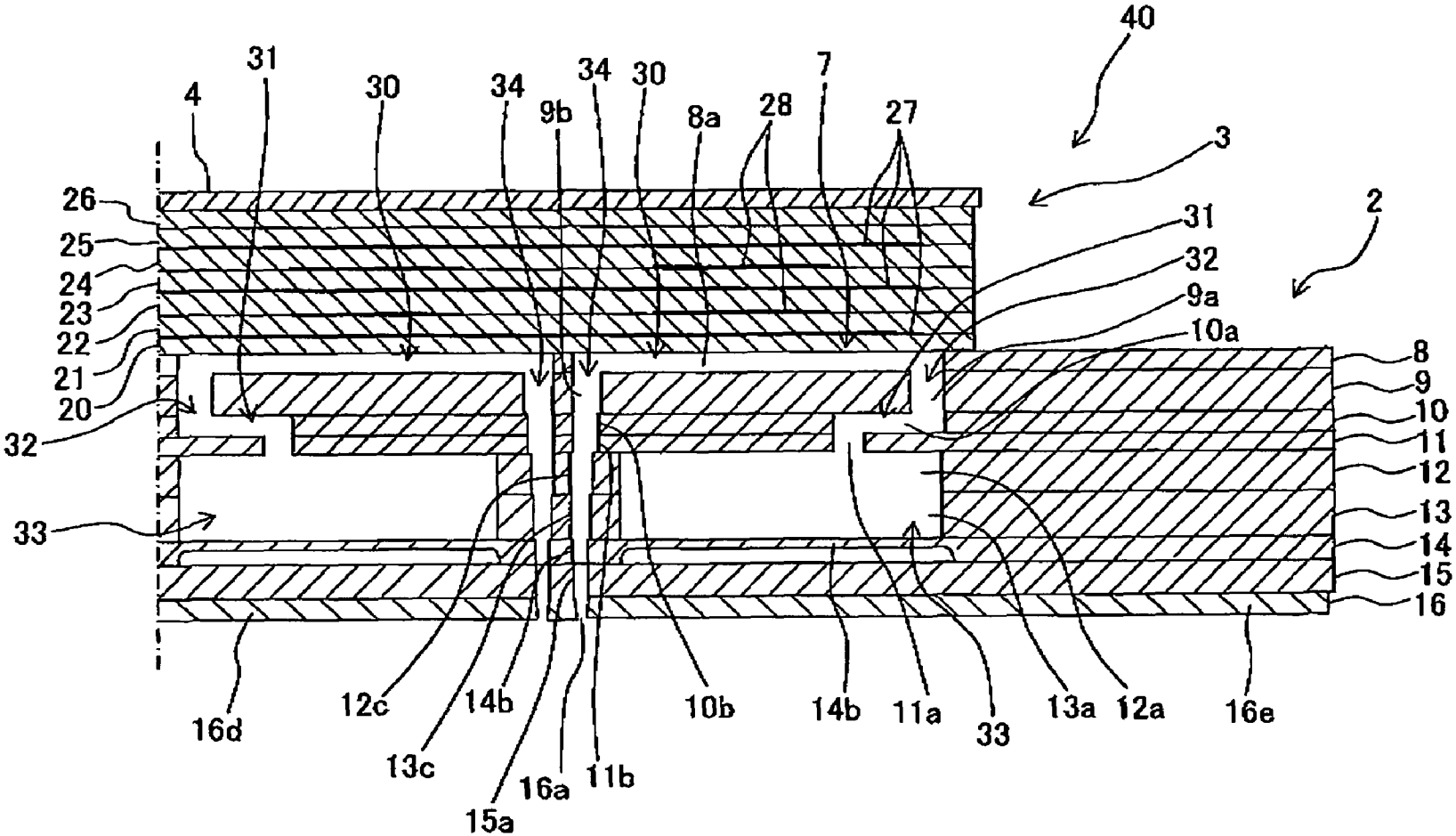
FIG. 4 is a cross-sectional view of the channel unit, taken along a line IV-IV of FIG. 2, in a state that an actuator and a flexible flat cable are staked on and adhered to the channel unit.

FIG. 3 is an exploded perspective view showing the structure of the channel unit 2 shown in FIG. 2. Further, FIG. 4 is a cross-sectional view of the channel unit 2, taken along a line IV-IV of FIG. 2, in a state that the actuator 3 and a flexible flat cable 4 are staked on and adhered to the channel unit 2. As shown in FIGS. 3 and 4, the channel unit 2 includes a pressure chamber plate 8, a first spacer plate 9, a constriction plate 10, a second spacer plate 11, a first manifold plate 12, a second manifold plate 13, a damper plate 14, a cover plate 15, and a nozzle plate 16 which are stacked in this order from the upper side to the lower side, and these plates are adhered in a stacked form.

The nozzle plate 16 is a resin sheet of a material such as polyimide, and each of the plates 8 to 15 other than the nozzle plate 16 is a metallic plate of a material such as 42% nickel alloy steel plate (42 alloy). Each of the plates 8 to 16 has a rectangular shape in a plan view, and has a thickness of about 50 μm to 150 μm. Openings or recesses are formed in each of the plates 8 to 15 by a method such as an electrolytic etching, a laser machining, and a plasma-jet machining, thereby defining a channel 7.

As shown in FIG. 3, ink receiving holes 8*b*, and a plurality of pressure chamber hole rows 8*c* each of which extends in a longitudinal direction (long side) of the pressure chamber plate 8 are formed in the pressure chamber plate 8. The pressure chamber hole rows 8*c* are arranged in a width direction of width (direction of a short side) of the pressure chamber plate 8. Here, five pressure chamber hole rows 8*c* (two rows for a black ink; and three rows for a cyan ink, a magenta ink, and a yellow ink, respectively) are formed in the pressure chamber plate 8. Each of the pressure chamber hole rows 8*c* includes a plurality of pressure chamber holes 8*a*. Each of the pressure chamber holes 8*a* is long in the width direction of the pressure chamber plate 8. Further, the actuator 3 is adhered to the pressure chamber plate 8 from the upper side of the pressure chamber plate 8, and the first spacer plate 9 is adhered to the pressure chamber plate 8 from the lower side of the pressure chamber plate 8. In this manner, by closing the openings of the pressure chamber holes 8*a*, pressure chambers 30 each having an internal space are formed (see FIG. 4). In this manner, a plurality of pressure chamber rows 36 (see FIG. 2), each of which has the plurality of pressure chambers 30, is formed in the channel unit 2. In the embodiment, five pressure chamber rows 36 (two rows for the black ink, and three rows for the cyan ink, the magenta ink, and the yellow ink respectively) are formed in the channel unit 2. Four ink receiving holes 8*b* are formed in the channel unit 2, each corresponding to one of the color inks (black, cyan, magenta, and yellow).

The first spacer plate 9 is provided with communicating holes 9*a* each of which communicates with one end of one of the pressure chamber holes 8*a* in the pressure chamber plate 8; a through holes 9*b* each of which communicates with the other end of one of the pressure chamber holes 8*a*; and ink receiving holes 9*c* each of which communicates with one of the ink receiving holes 8*b*. Further, each of the ink receiving holes 8*b* and one of the ink receiving holes 9*c* corresponding thereto have a same shape in a plan view.

Constriction holes 10*a* each of which has an elliptical shape elongated in one direction is formed in the constriction plate 10; and each of the communicating holes 9*a* in the first spacer plate 9 communicates with one end of one of the constriction holes 10*a*. Further, through holes 10*b* communicating with the through hole 9*b* respectively and ink receiving holes 10*c* communicating with the ink receiving holes 9*c* respectively are formed in the constriction plate 10. Furthermore, the shape of the through hole 9*b* and the shape of the ink receiving hole 9*c* are same as the shape of the through hole 10*b* and the shape of the ink receiving hole 10*c*, respectively. The plates are adhered are stacked with each other and fixed to each other in a state that the constriction plate 10 is sandwiched between the first spacer plate 9 and the second spacer plate 11. Accordingly, the constriction holes 10*a* are covered by the first spacer plate 9 and the second spacer plate 11, and thus constriction portions 31 are formed (see FIG. 4).

Communicating holes 11*a* each of which communicates with the other end of one of the constriction holes 10*a* formed in the constriction plate 10; and through holes 11*b* each of which communicates with one of the through holes 10*b* in the constriction plate 10 are formed in the second spacer plate 11. The through holes 10*b* and the through holes 11*b* have a same shape in a plan view. Further, constriction passages 32, each of which communicates one of the pressure chamber 30 and a common ink chamber 33 (which will be described later), are defined by one of the communicating holes 9*a* in the first spacer plate 9, one of the constriction holes 10*a* in the constriction plate 10, and one of the communicating holes 11*a* in the second spacer plate 11 (see FIG. 4). Furthermore, ink receiving holes 11*c* each of which communicates with one of the ink receiving holes 10*c* in the constriction plate 10 are formed in the second spacer plate 11. Here, the ink receiving holes 10*c* and the ink receiving holes 11*c* have the same shape in a plan view.

Five partitioned manifold holes 12*a*, which extend along the pressure chamber hole rows 8*c*, respectively, are formed in the first manifold plate 12, each at a position corresponding to the lower side of the pressure chambers 30 in one of the pressure chamber hole rows 8*c*. Two rows of the partitioned manifold holes 12*a* are provided for the black ink, and three rows of the partitioned manifold holes 12*a* are provided for the cyan ink, the magenta ink, and the yellow ink respectively. Each of the partitioned manifold holes 12 communicates with the pressure chamber 30 in one of the pressure chamber hole rows 8*c*, via the constriction passage 32. Further, one end of each of the partitioned manifold holes 12*a* also communicates with one of the ink receiving holes 11*c* in the second spacer plate 11. Furthermore, in the first manifold plate 12*a*, a plurality of through holes 12*c* is formed in a longitudinal direction of each of the partitioned manifold holes 12*a*. The through holes 12*c* communicate with the through holes 11*b* in the second spacer plate 11 respectively, and the through hole 12*c* and the through hole 11*b* have mutually same shape.

The second manifold plate 13 has a similar shape as the first manifold plate 12. In other words, in the second manifold plate 13, five partitioned manifold holes 13*a* and through holes 13*c* are formed corresponding to the five partitioned manifold holes 12*a* and the through holes 12*c* formed in the first manifold plate 12 respectively. Further, when the second spacer plate 11, the first manifold plate 12, the second manifold plate 13, and the damper plate 14 are stacked and adhered onto each other, five common ink chambers 33 are defined by the partitioned manifold holes 12*a* and 13*a* (see FIG. 4). Among these common ink chambers 33, two adjacent common ink chambers 33 are for the black ink, and the remaining three common ink chambers 33 are for the cyan ink, the magenta ink, and the yellow ink respectively.

The damper plate 14 has five damper walls (thin wall portions, damper grooves) 14*a* which are formed to have a thinner wall thickness by forming dents, from the lower side, at locations corresponding to the common ink chambers 33 respectively. Further, through holes 14*b* each of which communicates with one of the through holes 13*c* in the second manifold plate 13 are formed in the damper plate 14 each along the longitudinal direction of one of the damper walls 14*a*.

Through holes 15*a* each of which communicates with one of the through holes 14*b* in the damper plate 14 are formed in the cover plate 15. The cover plate 15 is arranged between the damper plate 14 and the nozzle plate 16. In a plan view, the through holes 15*a*, 14*b*, and 13*c* have a substantially same shape.

Nozzle holes 16*a* each of which communicates with one of the through holes 15*a* in the cover plate 15 are formed in the nozzle plate 16. The nozzle holes 16*a* are formed corresponding to the pressure chamber holes 8*a* respectively. The plurality of nozzle holes 16*a* form five nozzle hole rows 16*b* extending in a direction parallel to the pressure chamber hole rows 8*c* described above. The nozzle hole rows 16*b* are arranged at an interval in a direction perpendicular to the parallel direction.

By stacking and adhering the plates 8 to 16, the channel unit 2 as shown in FIG. 4 is formed. In the channel unit 2, the ink receiving holes 8*b*, 9*c*, and 11*c* (see FIG. 3) formed in the plates 8 to 11 respectively, are communicated mutually, thereby forming an ink receiving channel 35 (see FIG. 2). The ink receiving channel 35 communicates with one end of each of the common ink chambers 33, and the ink which is to be supplied from the ink tank to the common ink chamber 33 flows through the ink receiving channel 35. Further, as described above, the communicating holes 9*a*, the constriction holes 10*a*, and the communicating holes 11*a* formed in the plates 9 to 11 respectively are mutually communicated, thereby defining the constriction passages 32 each of which makes communicate the common ink chamber 33 and one of the pressure chambers 30. Further, the through holes 9*b*, 10*b*, 11*b*, 12*c*, 13*c*, 14*b*, and 15*a* formed in the plates 9 to 16 respectively are mutually communicated, thereby defining ink outflow channels (ink discharge channels) 34. Each of the ink discharge channels 34 communicates with one of the pressure chambers 30 and one of the nozzle holes 16*a* opening on the lower surface of the channel unit 2. Further, in the channel unit 2, a filter 17 which removes dust entered in and mixed into the ink supplied from the ink tank is fixed to ink receiving ports 35*a* each of which is an external opening end of each of the ink receiving channels 35.

On the other hand, as shown in FIG. 4, the actuator 3 is formed by stacking a plurality of piezoelectric sheets 20, 21, 22, 23, 24 and 25 and a top sheet 26 having an insulating property. Each of the piezoelectric sheets 20 to 25 is formed of a ceramics material of lead zirconate titanate (PZT) having a thickness of about 30 μm. The piezoelectric sheets 20 to 25 have a rectangular shape slightly smaller than the plates 8 to 16 (also see FIG. 3). On the upper surface of each of the piezoelectric sheets 20, 22, and 24, a common electrode 27 is formed by means of printing. The common electrode 27 corresponds to all the pressure chambers 30 (see FIG. 4) formed by the pressure chamber plate 8 of the channel unit 2. On the upper surface of each of the piezoelectric sheets 21 and 23, a plurality of individual electrodes 28 corresponding individually to the pressure chambers 30 respectively, is formed. Although FIG. 4 shows the individual electrodes 28 as being arranged in two rows, the individual electrodes 28 are actually formed to be arranged in five rows. The piezoelectric sheets 20, 22, and 24 on each of which the common electrode 27 is formed are odd numbered piezoelectric sheets when counted upward from the lowermost piezoelectric sheet 20, and the piezoelectric sheets 21 and 23 on each of which the individual electrodes 28 are formed are even numbered piezoelectric sheets when counted upward from the lowermost piezoelectric sheet 20. Further, the common electrode 27 and the individual electrodes 28 are brought into electrical conduction with the surface electrodes 5 provided on the upper surface of the top sheet 26 which is the uppermost layer, via junction wires (not shown in the diagram) provided on a side-end surface or in through holes (not shown in the diagram) of the piezoelectric sheets 20 to 25, and the top sheet 26.

In the following, an explanation will be given about an operation of jetting the ink (liquid droplets) from the nozzle holes 16*a* in the ink-jet head 40 having such structure. Firstly, the ink which is supplied from the ink tank (not shown in the diagram) via the filter 17 is filled in the channel 7 formed by the ink receiving channel 35, the common ink chamber 33, the constriction passage 32, the pressure chamber 30, and the ink discharge channel 34. In this state, a driving signal is selectively imparted (applied) from an outside to the individual electrodes 28 via a signal wire. At this time, an electrical potential difference is generated between the common electrode 27 and a certain individual electrode 28 among the individual electrodes 28 to which the driving signal is applied, and an electric field acts on a active portion of the piezoelectric sheets 21 to 24, thereby generating warping deformation in the stacking direction in which the plates are stacked. Here, the term "active portion" means a portion of the piezoelectric sheets 21 to 24 sandwiched between the certain individual electrode 28 and the common electrode 27, and substantively means, as mentioned above, a portion in which the warping deformation in the stacking direction is generated. When the active portion is deformed in such manner, the piezoelectric sheet 20 at the lowermost layer is deformed toward the inner side of the pressure chamber 30, thus decreasing the volume of the pressure chamber 30. With the deformation, the inner pressure of the pressure chamber 30 increases, and thus the ink inside the pressure chamber 30 is jetted, to outside, from the nozzle hole 16*a* through the ink discharge channel 34.

Next, the liquid droplet jetting-inspection apparatus 1 which inspects the ink-jet head 40 will be described below while referring to FIG. 1. The liquid droplet jetting-inspection apparatus 1, includes mainly, a pressurized liquid supply mechanism 204 having a pump 41, a pipe 42, and a pressure control valve 43; a recording head driving circuit (liquid jetting control mechanism) 44; a light emitting mechanism 51 having a synchronized drive circuit 46 and a light source 47; a camera (an image pickup mechanism) 48; a monitor 49; and a defect judging section (a defect judging mechanism) 50. In the embodiment, the light emitting mechanism 51 has the synchronized drive circuit 46 and the light source 47. However, the light emitting mechanism 51 may have only a light source.

The pump 41 is a heretofore known general purpose pump which supplies a pressurized liquid, pressurized water in the embodiment (hereinafter, called as 'pressurized liquid'). A discharge port (not shown in the diagram) of the pump 41 is connected to one of the ink receiving ports 35*a* of the ink-jet head 40 via the pipe 42. Therefore, the pump 41 is capable of supplying the pressurized liquid to the ink receiving port 35*a*. Moreover, the pressure control valve 43 which controls a pressure of the pressurized liquid flowing through the pipe 42 is provided in the middle of the pipe 42. The pump 41 may have a built-in tank which stores the liquid to be supplied to the ink-jet head 40, or the tank may be provided independently of the pump 41.

The recording head driving circuit 44 is capable of outputting a driving signal for driving the ink-jet head 40 at a predetermined time interval. The recording head driving circuit 44 is electrically connected to the actuator 3 via the flexible flat cable 4. Concretely, the recording head driving circuit 44 is connected independently to each of the surface electrodes 5 of the actuator 3 via the signal wires of the flexible flat cable 4. Consequently, the driving signal which is output from the recording head driving circuit 44 is transmitted independently to each of the individual electrodes 28, and it is possible to make the liquid droplets jet from each of the nozzles 16*a*.

Figure 5:
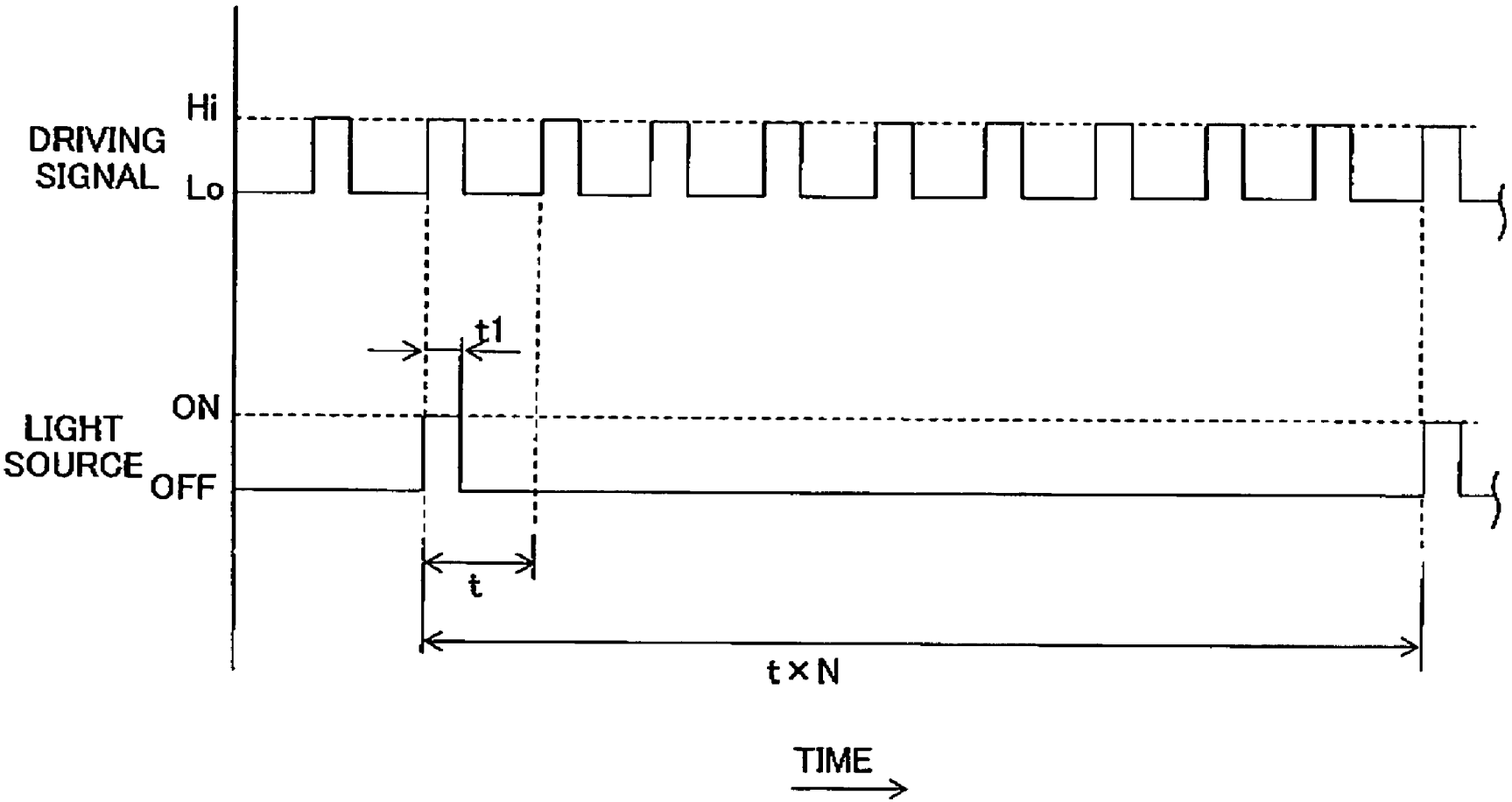
FIG. 5 is a diagram showing the time-dependent change of ON/OFF switching timing of a light source and of a driving signal in the liquid droplet jetting-inspection apparatus 1 shown in FIG. 1.

FIG. 5 is a diagram showing the time-dependent change of ON/OFF switching timing of the light source 47 and the driving signal in the liquid droplet jetting-inspection apparatus 1 in FIG. 1. In FIG. 5, a vertical axis shows Hi/Lo and ON/OFF, and a horizontal axis shows time. As shown in FIG. 5, the driving signal is a plurality of pulse signals for which Lo and Hi changes (is switched) at a predetermined time interval t (cycle t), and is a pulse signal of which frequency is 9 kHz for example.

Furthermore, the recording head driving circuit 44 is capable of outputting a driving signal also to the synchronized drive circuit 46. The synchronized drive circuit 46 synchronizes with the driving signal from the recording head driving circuit 44, and makes blink the light source 47 which will be described later. The light source 47 includes an LED for example, and when is switched to ON, the light source 47 irradiates light on liquid droplets which are jetted from the ink-jet head 40. The synchronized drive circuit 46 switches (changes) ON and OFF of the light source 47 by synchronizing with the driving signal, and makes the light be emitted from the light source only for a time t1 (sea) at an interval N times (N is an integer) of the predetermined time interval t. In the embodiment, the light source 47 is made to emit light for time t1 (sec) at a frequency of 1 kHz. In other words, the light source 47 is made to emit light for the time t1 (sec) for nine times of the predetermined time interval t.

The camera 48 which is the image pickup mechanism (imaging mechanism) is arranged at a position facing the light source 47. The ink-jet head 40 is arranged such that the liquid and/or the liquid droplets are jetted between the light source 47 and the camera 48 facing mutually. More elaborately, the ink-jet head 40 is arranged such that the liquid and/or the liquid droplets jetted from one of the nozzle rows 16*b* are arranged on a plane perpendicular to an optical axis of the camera 48. The camera 48 is a so-called CCD (charge coupled device) camera, and is capable of picking an image of the liquid or the liquid droplets jetted, and recording the change with the lapse of time as a moving image (movie). The monitor 49 is a display such as a liquid crystal display, and is capable of displaying upon magnifying the moving image captured by the camera 48. The defect judging section 50 is a so-called personal computer, and judges a defect (such as a jetting defect) of the ink-jet head 40, based on the moving image captured by the camera 48.

Figure 6:
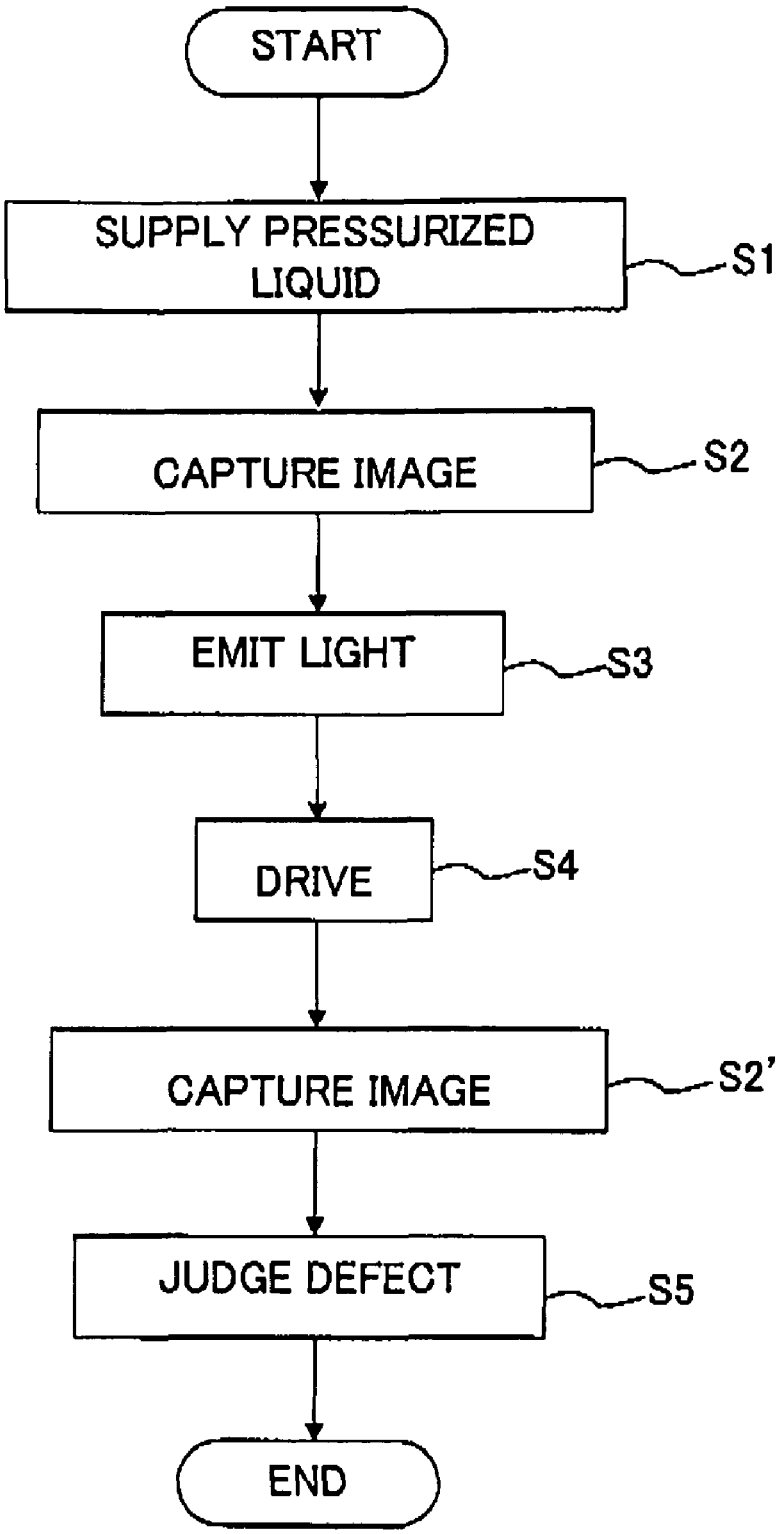
FIG. 6 is a flowchart showing a procedure for a liquid droplet jetting-inspection method.
Figure 7:
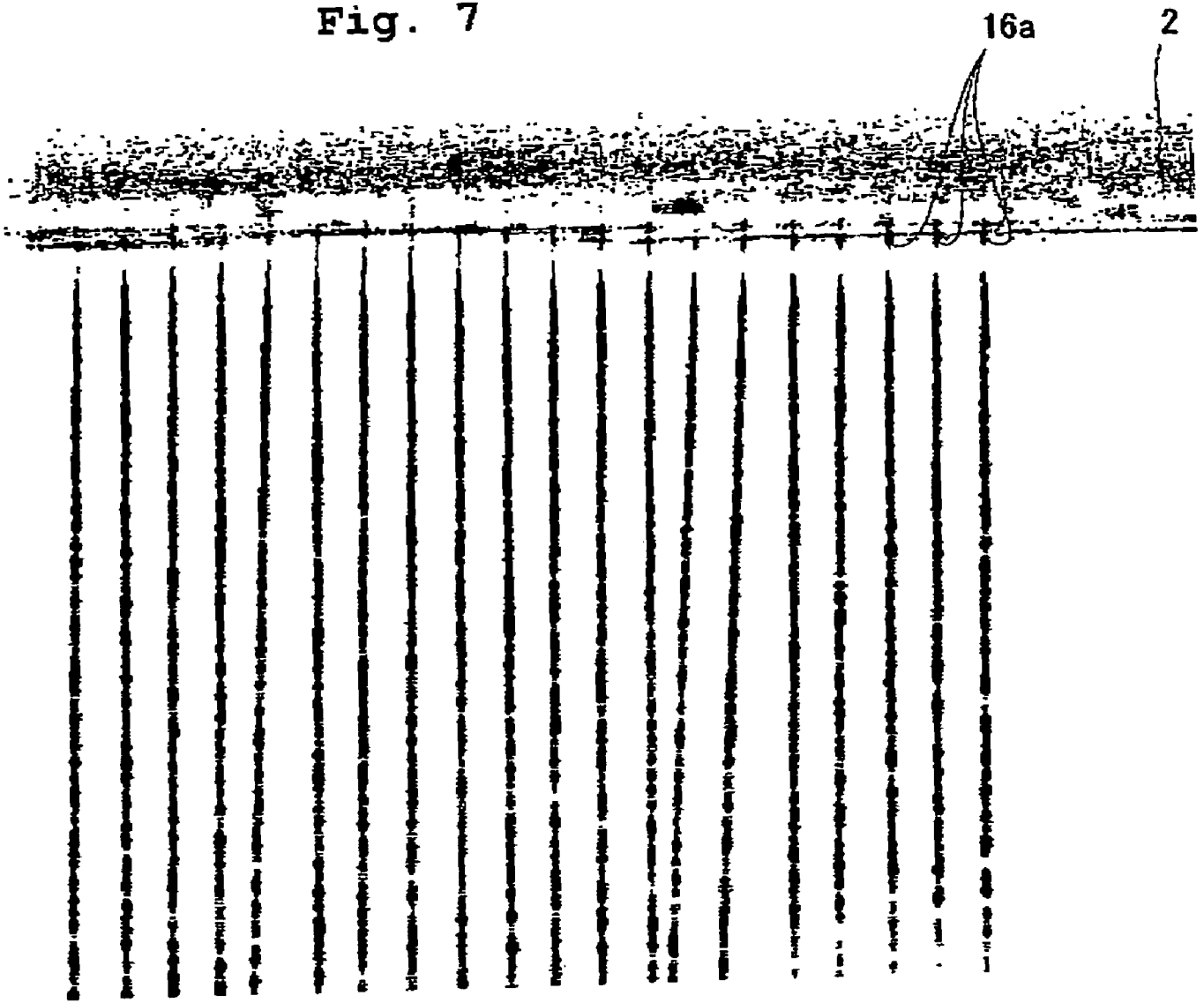
FIG. 7 is a diagram showing a state of a liquid discharged (flowed out) from nozzles when a pressurized liquid is supplied to the liquid droplet-jetting apparatus.
Figure 8:
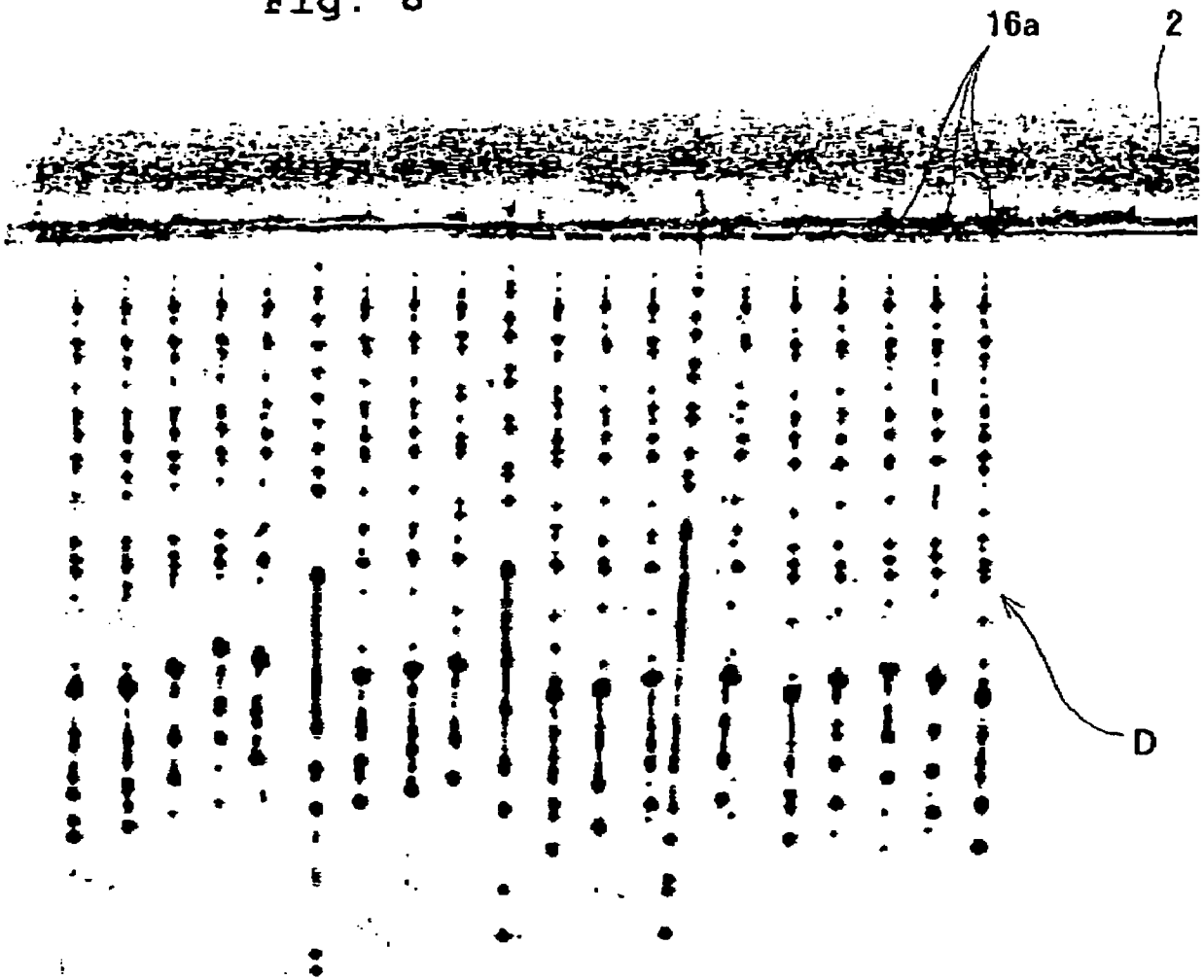
FIG. 8 is diagram showing a state of the liquid jetted from nozzles 16*a* when the driving signal is applied to the ink-jet head in a state that the pressurized liquid is supplied to the liquid droplet-jetting apparatus.

FIG. 6 is a flowchart showing a procedure for a liquid droplet jetting-inspection method. FIG. 7 is a diagram showing a state of a liquid which outflows from the nozzle 16*a* when a pressurized liquid is supplied to the inkjet head 40 via the ink receiving port 35*a*. FIG. 8 is a diagram showing a state of liquid droplets jetted from the nozzle 16*a* when the driving signal is applied to the ink-jet head 40, with the pressurized liquid supplied to the ink receiving port 35*a*. It is preferable that the jetting of the liquid and the liquid droplet in the liquid droplet jetting-inspection method is carried out in a dark room.

The following explanation will be made with reference to the flowchart in FIG. 6. Firstly, the pump 41 is driven after connecting the pipe 42 to the ink receiving port 35*a* which communicates with a certain pressure chamber row 36, and a pressurized liquid which is controlled at a constant pressure by the pressure control valve 43 is supplied to the ink-jet head 40 (step S1). Accordingly, the pressurized liquid outflows continuously from all nozzles 16*a* in one of the nozzle hole rows 16*b* which communicates with that ink receiving port 35*a*. At this time, the pressure to be applied to the pressurized liquid is controlled to a level at which the liquid outflowing from the nozzles 16*a* forms a continuous line. This state is captured by the camera 48, and an image which is picked up is displayed upon magnifying on the monitor 49 (step S2). FIG. 7 shows a state of an outflow of the liquid which outflows from the nozzle 16*a*. At this time, as it will be described later, it can be arbitrary whether the light source 47 is made to blink or not.

Next, with the pressurized liquid supplied to the ink-jet head 40, a driving signal is output from the recording head driving circuit 44. This driving signal is output to the individual electrodes 28 corresponding to the pressure chamber row 36 which corresponds to a certain ink receiving port 35*a*. Concurrently, the synchronized drive circuit 46 synchronizes with the driving signal which is output, and makes the light source 47 blink at a time interval which is N times the predetermined time interval t (step S3). Here, N is a positive integer, and in the embodiment, N is 9 as described above.

As described above, when the ink-jet head 40 is driven at the predetermined time interval, liquid droplets D which are jetted at each predetermined time interval t from the nozzle 16*a* are added to the pressurized liquid which has been jetted continuously, and the liquid droplets D are continuous in the form of beads (step S4). By making the light source 47 emit light upon synchronizing with the driving signal, the image captured by the camera 48 becomes a pseudo stationary image in which the liquid droplets D are continuous in the form of beads as shown in FIG. 8, and is displayed on the monitor 49.

When an interval of light emission from the light source 47 is shifted (changed) slightly from N times of the time interval of the driving signal, an image in which the liquid droplets D are observed to be moving slowly in a continuous state in the form of beads is achieved. For inspecting the ink-jet head 40, it is possible to use any of the stationary image and the moving image mentioned above. The image captured by the camera 48 is recorded in a recording medium which is not shown in the diagram. In the present patent application, in both cases namely, a case of achieving the slowly moving image in which the liquid droplets D are in the continuous state in the form of beads upon shifting the time interval of the driving signal slightly from N times as mentioned above, and a case of achieving the stationary image in which, the liquid droplets D are in the continuous state in the form of beads at the time interval of N times, it is called as N times.

Finally, a jetting defect of the ink-jet head 40 is judged based on the image which is recorded in the recording medium (step S5). Regarding a judging method, it is possible to judge by checking visually the image on the monitor 49, and it is also possible to judge by an image processing apparatus (defect judging section (jetting defect judging section)) 50. In the defect judging section 50, images of a liquid and liquid droplets which are jetted from the nozzles 16*a* by a procedure similar as in steps from step S1 to step S4 for a non-defective ink-jet head 40 are recorded, and a judgment of whether there is a defect (abnormal jetting) or not is made by comparing these recorded images and images which are stored upon capturing by the camera 48. For instance, an existence or a non-existence of a line formed by a liquid outflowed from the nozzle or liquid droplets jetted from the nozzle, a degree of inclination of that line, an existence or a non-existence of liquid droplets, a degree of continuity of the liquid droplets, and a difference in a horizontal position of liquid droplets are found. A judgment of whether or not there is a defect in the ink-jet head 40 is made depending on whether or not the values obtained are within a range of allowable values which are determined in advance. The method of judging is described below by citing a concrete example.

Figure 9:
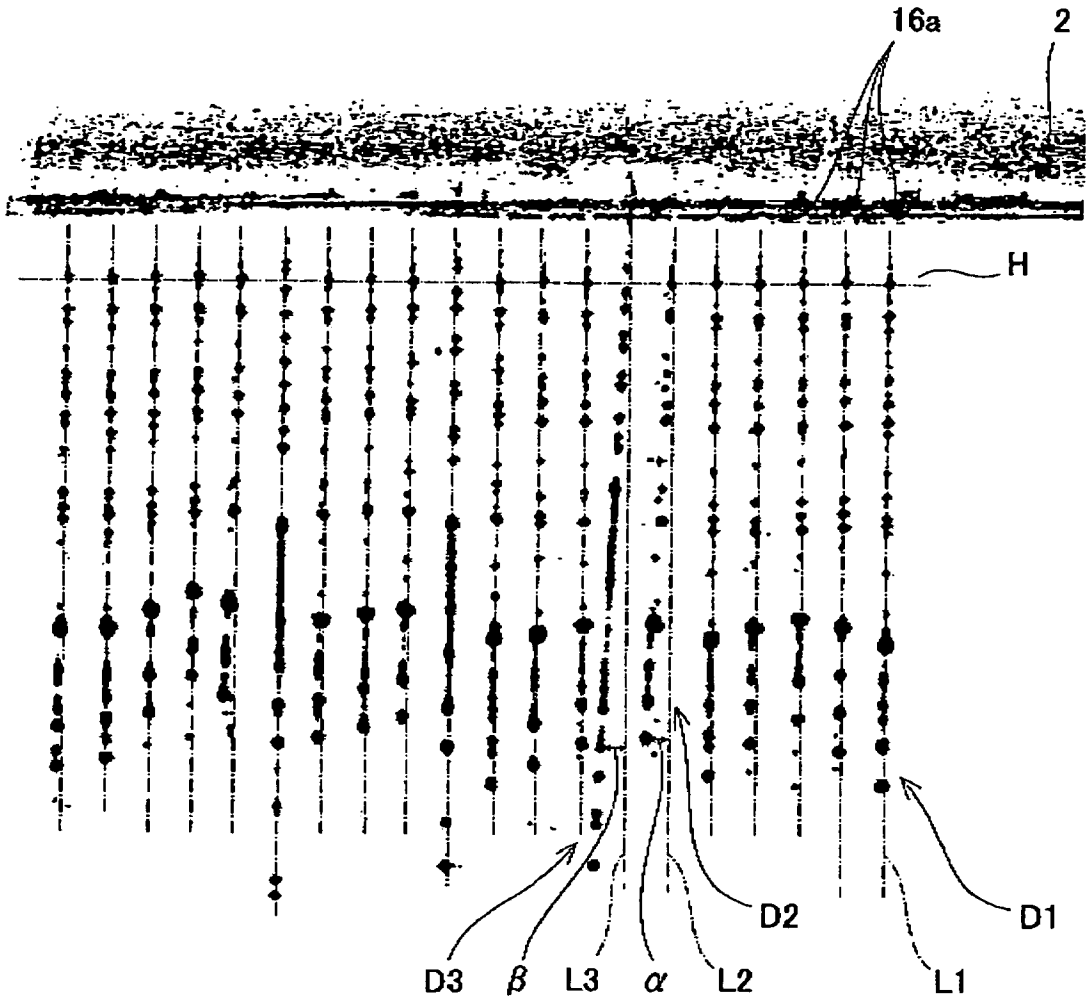
FIG. 9 is a diagram in which an auxiliary line is added for easily explaining the inspection method.

A misjetting and a bending in a jetting direction caused due to a channel and a nozzle will be described with reference to FIG. 9. FIG. 9 is a diagram showing a jetting condition (state) same as in FIG. 8, and is a diagram in which an auxiliary line is added for making the description of the inspection method easy. In FIG. 9, a locus (track) (hereinafter, called as 'locus') of liquid droplets jetted from the nozzles 16*a* of the non-defective ink-jet head 40 is shown by alternate long and short dashed lines extended in a vertical direction in FIG. 9.

Firstly, a liquid droplet D1 at an extreme right side in FIG. 9 will be described below. The liquid droplet D1 is jetted along a locus L1, and a judgment that there is no bending in the jetting direction of this nozzle is made. Moreover, sixth and seventh liquid droplets D2 and D3 from the right side are jetted upon being inclined by angles $\alpha$ and $\beta$ respectively, with respect a locus L2. When the angles $\alpha$ and $\beta$ are within an allowable angle range, the ink-jet head 40 is judged to be non-defective, and when the angles $\alpha$ and $\beta$ are out of the range, the ink-jet head 40 is judged to be defective. It is possible to carry out the inspection of the jetting defect and the bending in the jetting direction caused due to a channel and a nozzle at a point of time when an image in FIG. 7 is obtained, without driving the ink-jet head 40, and it is possible to carry out the inspection even when the ink-jet head 40 is driven.

Moreover, a zone in which the liquid droplet D1 is formed continuously with liquid droplets before and after is not seen in substantially continuous state in the form of beads, of the liquid droplet D1, but the liquid droplet D3 is continuous with liquid droplets before and after in a part of a zone A. Furthermore, when a horizontal line H is drawn at a fixed distance from the nozzle 16*a* with a predetermined liquid droplet position as a reference (a base), it is possible to detect liquid droplets which are jetted in retard. Such continuing of the liquid droplets before and after and being driven in retard are judged as a defect caused due to an electrical structure and/or an active portion of the actuator. Depending on whether or not these are within an allowable range, the ink-jet head 40 is judged to be non-defective or defective.

When the inspection is completed for one of the pressure chamber rows 36, the inspection is carried out by a similar method for another pressure chamber row 36. This is carried out repeatedly and when the inspection of all five pressure chamber rows 36 is completed and no defect is found at all, the ink-jet head 40 subjected to inspection is judged to be non-defective.

In the liquid droplet jetting-inspection apparatus 1 and the liquid droplet jetting-inspection method described above, it is not necessary to use a high cost camera having an extremely short image pickup time (such as an ultra high-speed camera with a shutter speed of few p sec or less), and it is possible to inspect easily the jetting condition from the multiple number of nozzles 16*a* of the ink-jet head 40 by using a comparatively low cost (cheaper) CCD camera (such as a CCD camera of a frame rate of about 30 fps).

Moreover, in the liquid droplet jetting-inspection apparatus and the liquid droplet jetting-inspection method according to the present invention, firstly, the pressurized liquid is jetted from the nozzles of the ink-jet head. Therefore, it is possible to identify (specify) a nozzle from which the liquid is not jetted due to clogging of the nozzle etc., and a nozzle from which the liquid droplets are jetted inclined due to bending of a channel etc. Thereafter, by driving the actuator, and inspecting the jetting condition of the liquid droplets arranged in the form of beads, it is possible to identify (specify) a nozzle in which, a jetting defect has occurred due to the actuator. In this manner, in the liquid droplet jetting-inspection apparatus and the liquid droplet jetting-inspection method according to the present invention, it is possible to distinguish easily a jetting defect due to a channel and a jetting defect due to the actuator.

Fundamentally, for jetting the liquid droplets from the ink-jet head, it is necessary that a channel is filled with the liquid. Therefore, normally, a preprocessing (preparation) of filling an inside of the channel by the liquid is carried out by carrying out a purge in advance before jetting the liquid droplets by driving the ink-jet head. Whereas, in the liquid droplet jetting-inspection apparatus and the liquid droplet jetting-inspection method according to the present invention, the pressurized liquid is jetted from the nozzle upon infusing (filling) the pressurized liquid in the ink-jet head. Therefore, it is possible to fill in short time, the inside of the channel of the ink-jet head by the pressurized liquid without carrying out a process such as the purge process. Therefore, it is possible to shorten the inspection time substantially.

The liquid droplet jetting-inspection apparatus 1 according to the present invention is capable of inspecting not only the ink jetting condition of an ink-jet head which is assembled as a finished product, but also the ink jetting condition of an ink-jet head which is a semi finished product (a partially completed product). In that case, the liquid droplet jetting-inspection apparatus 1, as it will be described later, may include a inspection-liquid supply mechanism 120 which supplies a pressurized liquid to the semi finished ink-jet head. Here, the semi finished ink-jet head means an ink-jet head which includes a channel unit and an actuator, and of which electrical structure is capable of being driven to jet the liquid, by connecting to the recording head driving circuit 44 of the liquid droplet jetting-inspection apparatus 1, by using a wire member such as a flexible flat cable.

Figure 10:
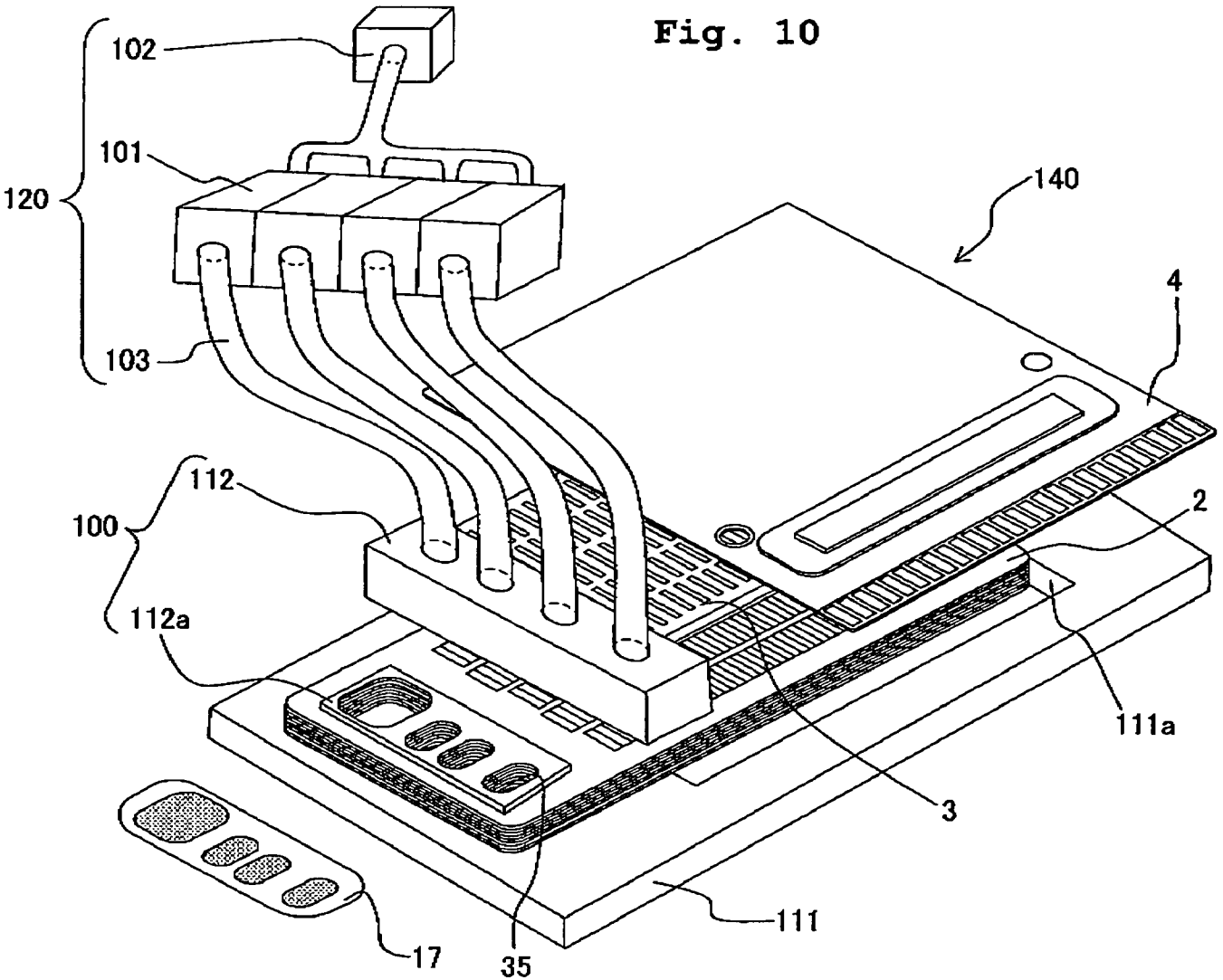
FIG. 10 is a diagram showing a inspection-liquid supply mechanism attached to an unfinished ink-jet head.

FIG. 10 is a diagram showing a state in which the inspection-liquid supply mechanism 120 is fixed to an ink-jet head 140 which is unfinished. The ink-jet head 140 includes the channel unit 2, the actuator 3 which is provided on the upper surface of the channel unit 2, and the flexible flat cable 4 fixed to the actuator 3. Although it is not shown in FIG. 10, one end of the flexible flat cable 4 is connected to the recording head driving circuit 44 of the liquid droplet jetting-inspection apparatus 1. Moreover, the inspection-liquid supply mechanism 120 includes a jig 100 which fixes the ink-jet head 140, a tank 101 which stores the liquid, a pump 102 which applies a pressure to the liquid, and a pipe 103 which communicates with the pump 102, the tank 101, and the ink-jet head 140. The jig 100 includes a frame 111 which is arranged on the lower surface of the channel unit 2, and a joint 112 which connects the pipe 103 to the ink receiving channel 35. The frame 111 is a plate member having a substantially rectangular shape, and a through hole 111*a* is formed in a portion on the lower surface of the channel unit 2, overlapping an area in which the nozzles are formed. Since the nozzles of the channel unit 2 are exposed at a lower side due to the through hole 111*a*, there is no possibility that the liquid jetted from the ink-jet head 140 makes a contact with the frame 111. A through hole for inserting the pipe 103 is formed in the joint 112*r* and the pipe 103 is connected to the ink receiving channel 35 by fixing the joint 112 to the frame 111 by a screw etc. Accordingly, the liquid inside the tank 101 is pressurized by the pump 102, and is supplied to the ink-jet head 140 via the pipe 103. Moreover, a filter 17 may be provided between the pipe 103 and the ink receiving channel 35. Furthermore, the joint 112 may have a packing 112*a* which tightly contacts with the pipe 103 so as to avoid from leaking the liquid at the junction between the pipe 103 and the joint 112. The inspection-liquid supply mechanism 120 may have a regulating valve 43 to regulate the pressure of the liquid.

In this manner, by using the inspection-liquid supply mechanism 120, it is possible to supply the pressurized liquid even for the unfinished ink-jet head, and to carry out inspection of the jetting condition by using the liquid droplet jetting-inspection apparatus 1. For example, a line head usually has a large number of nozzles provided in one head, and is mounted (installed) on a large size ink-jet printer. In a case of such an expensive ink-jet head, it is desirable to distinguish an ink-jet head having a jetting defect by carrying out inspection in an unfinished state, and to eliminate a defective product, rather than by inspecting the jetting upon bringing it to a state of a finished product. In such case, by combining the liquid droplet jetting-inspection apparatus 1 and the inspection-liquid supply mechanism 120 described above, it is possible to inspect an ink-jet head even in an unfinished state. In the abovementioned description, although the inspection-liquid supply mechanism 120 has been provided independent of the pressurized liquid supply mechanism 204 of the liquid droplet jetting-inspection apparatus 1, the inspection-liquid supply mechanism 120 and the pressurized liquid supply mechanism 204 may be provided integrally. For example, a pump of the pressurized liquid supply mechanism 204 may function as the tank 101 and the pump 102 of the inspection-liquid supply mechanism 120.

In the embodiment described above, an ink-jet head which is driven by a piezoelectric method (type) has been described as the ink-jet head. However, an ink-jet head driven by static electricity and heat generation is also applicable similarly. Furthermore, a liquid droplet-jetting apparatus which is substantiated in an ink-jet head has been described as the liquid droplet-jetting apparatus. However, it is also applicable to liquid droplet-jetting apparatuses which use other types of liquids, such as an apparatus which applies a colored liquid for manufacturing a color filter of a liquid-crystal display apparatus for example.

Moreover, in the embodiment described above, properties of the ink (to be) used in the ink-jet head being closer to properties of water, water has been used for inspection. However, it is preferable to carry out inspection by using ink, according to the properties of the ink. Even in liquid droplet-jetting apparatuses which use other types of liquids, it is possible to carry out inspection by substituting by a low cost liquid having properties closer to properties of that liquid. In the liquid droplet jetting-inspection apparatus and the liquid droplet jetting-inspection method according to the present invention, since the ink-jet head is arranged between the light source and the camera, liquid droplets (liquid) are captured as a shadow. Therefore, when a transmittance of the liquid is low, it is possible to improve (increase) a contrast of an image which is captured, and to detect clearly (sharply) a shape of the liquid droplets (liquid). For example, by using a colored ink instead of water as a pressurized liquid, it is possible to improve the contrast of an image which is obtained by inspection.

As it has been described above, the liquid droplet jetting-inspection apparatus and the liquid droplet jetting-inspection method according to the present invention has an excellent effect of being capable of detecting easily a defect caused due to a channel, a nozzle, and an electrical structure and a drive element of the liquid droplet-jetting apparatus, and are useful when applied to an apparatus and a method of inspection a defect in a liquid droplet-jetting apparatus such as an ink-jet head. Moreover, it is also possible to use the liquid droplet jetting-inspection apparatus and the liquid droplet jetting-inspection method according to the present invention for total inspection (100% inspection) of a liquid droplet-jetting apparatus such as an ink-jet head, and for a sampling inspection. Moreover, although the liquid droplet jetting-inspection apparatus described above has the synchronized drive circuit, the image pickup mechanism, and the defect detecting mechanism, these circuits and mechanisms are not indispensable.

What is claimed is:

1. A liquid droplet jetting-inspection apparatus which inspects jetting of a liquid droplet-jetting apparatus having a nozzle through which liquid droplets of a liquid are jetted and causing change in pressure of the liquid based on a predetermined driving signal to jet the liquid droplets from the nozzles, the liquid droplet jetting-inspection apparatus including:

a pressurized liquid supply mechanism which pressurizes the liquid, and supplies the pressurized liquid to the liquid droplet-jetting apparatus to make the liquid be discharged continuously from the nozzle; and a liquid droplet-jetting control mechanism which applies the driving signal at a predetermined time interval to the liquid droplet-jetting apparatus, during which the liquid is continuously discharged from the nozzle; and a light emitting mechanism which includes a light source, and which makes the light source emit light at a time interval that is an integer multiply of the predetermined time interval.

2. The liquid droplet jetting-inspection apparatus according to claim 1, wherein the light emitting mechanism has a synchronized drive circuit which makes the lights source emit the light in synchronization with the driving signal.

3. The liquid droplet jetting-inspection apparatus according to claim 1, further comprising an image pickup mechanism which takes an image of the liquid jetted from the nozzles, during which the pressurized liquid supply mechanism and the light emitting mechanism are operating.

4. The liquid droplet jetting-inspection apparatus according to claim 3, further comprising a defect detecting mechanism which detects a defect, of the liquid droplet-jetting apparatus, based on the image taken by the image pickup mechanism.

5. The liquid droplet jetting-inspection apparatus according to claim 3, wherein the liquid is a colored liquid.

6. The liquid droplet jetting-inspection apparatus according to claim 1, wherein the pressurized liquid supply mechanism includes: a tank which stores the liquid; a pump which pressurizes the liquid; and a piping which connects the tank and the pump to the liquid droplet-jetting apparatus.

7. The liquid droplet jetting-inspection apparatus according to claim 6, wherein the pressurized liquid supply mechanism further includes: a frame which fixes the liquid droplet-jetting apparatus; and a jig including a joint which is fixed to the frame and which connects the piping to the liquid droplet-jetting apparatus so that the liquid is communicable between the piping and the liquid droplet-jetting apparatus.

8. The liquid droplet jetting-inspection apparatus according to claim 6, wherein the pressurized liquid supply mechanism further includes a pressure control valve which adjusts the pressure of the liquid.

* * * * *